US010862206B2

(12) United States Patent
Tsuchiya et al.

(10) Patent No.: US 10,862,206 B2
(45) Date of Patent: Dec. 8, 2020

(54) ANTENNA DEVICE

(71) Applicant: DENSO TEN Limited, Kobe (JP)

(72) Inventors: Junzoh Tsuchiya, Kobe (JP); Kenta Shirahige, Kobe (JP); Norihisa Nishimoto, Kobe (JP)

(73) Assignee: DENSO TEN Limited, Kobe-shi (JP)

( * ) Notice: Subject to any disclaimer, the term of this patent is extended or adjusted under 35 U.S.C. 154(b) by 18 days.

(21) Appl. No.: 16/354,721

(22) Filed: Mar. 15, 2019

(65) Prior Publication Data

US 2020/0058995 A1 Feb. 20, 2020

(30) Foreign Application Priority Data

Aug. 16, 2018 (JP) ..... 2018-153140

(51) Int. Cl.
*H01Q 1/52* (2006.01)
*H01Q 21/06* (2006.01)
*H01Q 21/00* (2006.01)

(52) U.S. Cl.
CPC ..... *H01Q 1/528* (2013.01); *H01Q 21/0006* (2013.01); *H01Q 21/065* (2013.01)

(58) Field of Classification Search
CPC ..... H01P 3/12; H01P 3/121–123; H01Q 1/52; H01Q 1/521; H01Q 1/528; H01Q 21/0006; H01Q 21/06; H01Q 21/065; H01Q 21/08; H01Q 21/10; H01Q 21/12; H01Q 1/523; H01Q 1/525; H01Q 1/526
See application file for complete search history.

(56) References Cited

U.S. PATENT DOCUMENTS

| | | | | |
|---|---|---|---|---|
| 7,471,247 | B2 * | 12/2008 | Saily | H01Q 1/523 343/700 MS |
| 9,502,778 | B2 * | 11/2016 | Shinkai | H01Q 1/38 |
| 9,692,132 | B2 | 6/2017 | Kawaguchi et al. | |
| 2008/0204347 | A1 * | 8/2008 | Alvey | H01Q 1/52 343/841 |
| 2009/0015499 | A1 * | 1/2009 | Kuroda | H01Q 15/008 343/787 |
| 2016/0028161 | A1 * | 1/2016 | Kawaguchi | H01Q 1/32 343/700 MS |
| 2019/0051977 | A1 * | 2/2019 | Kawaguchi | H01Q 13/08 |

FOREIGN PATENT DOCUMENTS

| | | |
|---|---|---|
| JP | 2002-510886 A | 4/2002 |
| JP | 2014-179680 A | 9/2014 |
| JP | 2017-152850 A | 8/2017 |
| JP | 2017-163375 A | 9/2017 |

* cited by examiner

*Primary Examiner* — Jason Crawford
(74) *Attorney, Agent, or Firm* — Oliff PLC

(57) ABSTRACT

An antenna device includes: an antenna unit provided as a conductive pattern on a substrate; and a propagation preventive unit which is provided adjacent to the antenna unit and prevents propagation of radiation waves of the antenna unit along the substrate, and the propagation preventive unit is provided as a conductive pattern on the substrate, has plural patches arranged in a prescribed pattern, and has, at an end on a side of the antenna unit, a stepped structure in which a distance from a position of the antenna unit to one of the patches closest to the position of the antenna unit varies by a prescribed interval every time the position in an extension direction of a feed line of the antenna unit is changed by a prescribed distance.

10 Claims, 7 Drawing Sheets

ANTENNA DEVICE

CROSS-REFERENCE TO RELATED APPLICATIONS

This application is based on and claims priority under 35 USC 119 from Japanese Patent Application No. 2018-153140 filed on Aug. 16, 2018.

FIELD OF THE INVENTION

The present invention relates to an antenna device.

BACKGROUND OF THE INVENTION

Various techniques relating to a planar antenna having antenna elements that are formed as a conductive pattern on a substrate have been proposed recently. For example, JP-T-2002-510886 (The symbol "JP-T" as used herein means a published Japanese translation of a PCT patent application), which relates to a method for removing a metal surface current, discloses a structure called a ground plane mesh to be used in combination with an antenna. The ground plane mesh has an EBG (electromagnetic band gap) structure in which plural conductive patches are arranged periodically on a flat surface. This configuration makes it possible to suppress propagation of antenna radiation waves along a substrate, unwanted emission of radio waves from edges of the substrate to the space, and generation of ripple etc. that affect the directivity of antenna radiation waves. This makes it possible to improve the degree of distortion of the beam pattern of antenna radiation waves.

SUMMARY OF THE INVENTION

However, antenna devices that utilize the conventional EBG structure including the technique disclosed in JP-T-2002-510886 are associated with an object that antenna radiation waves are reflected by end surfaces of patches of the EBG structure and produce interference waves in an end region, opposed to the antenna, of the EDB structure. Radiation waves that are radiated to the space directly from the antenna may be affected by interference waves from the EBG structure, to distort the beam pattern of antenna radiation waves.

The present invention has been made in view of the above object, and the present invention is therefore to provide a technique capable of suppressing the influence of interference waves that would otherwise distort the beam pattern of antenna radiation waves.

An antenna device of the present invention includes: an antenna unit formed as a conductive pattern on a substrate; and a propagation preventive unit which is formed adjacent to the antenna unit and prevents propagation of radiation waves of the antenna unit along the substrate. The propagation preventive unit is formed as a conductive pattern on the substrate, has plural patches arranged in a prescribed pattern, and has, at an end on the side of the antenna unit, a stepped structure in which the distance from the antenna unit to a patch closest to the antenna unit varies by a prescribed interval every time the position in an extension direction of a feed line of the antenna unit is changed by a prescribed distance (First Configuration).

Further, in the antenna device of the First Configuration, it may be that the prescribed interval is equal to a ½ guide wavelength of radiation waves of the antenna unit (Second Configuration).

Further, in the antenna device of the First Configuration, it may be that the prescribed interval is equal to a ¼ guide wavelength of radiation waves of the antenna unit (Third Configuration).

Further, in the antenna devices of the First to Third Configurations, it may be that the shortest one of distances from the antenna unit to the closest patches of the stepped structure is equal to an integer multiple of a guide wavelength of radiation waves of the antenna unit (Fourth Configuration).

Further, in the antenna devices of the First to Fourth Configurations, it may be that the stepped structure is shaped like a rectangular wave (Fifth Configuration).

Further, in the antenna devices of the First to Fourth Configurations, it may be that the stepped structure is inclined so as to extend in such a direction as to come closer to or go away from the antenna unit (Sixth Configuration).

Further, in the antenna devices of the First to Sixth Configurations, it may be that each of the plural patches is shaped like a polygon or a circle (Seventh Configuration).

According to the configuration of the invention, interference waves that are generated by end surfaces of the closest patches of the antenna unit (having an EBG structure, for example) for preventing propagation of radiation waves of the antenna unit along the substrate can be canceled out by the stepped structure. As a result, in the antenna device, the influence of interference waves that would otherwise distort the beam pattern of antenna radiation waves can be suppressed.

DETAILED DESCRIPTION OF THE INVENTION

An illustrative embodiment of the present invention will be hereinafter described in detail with reference to the drawings. The invention is not limited to the following disclosure.

1. General Configuration of Antenna Device 1

Figure 1:
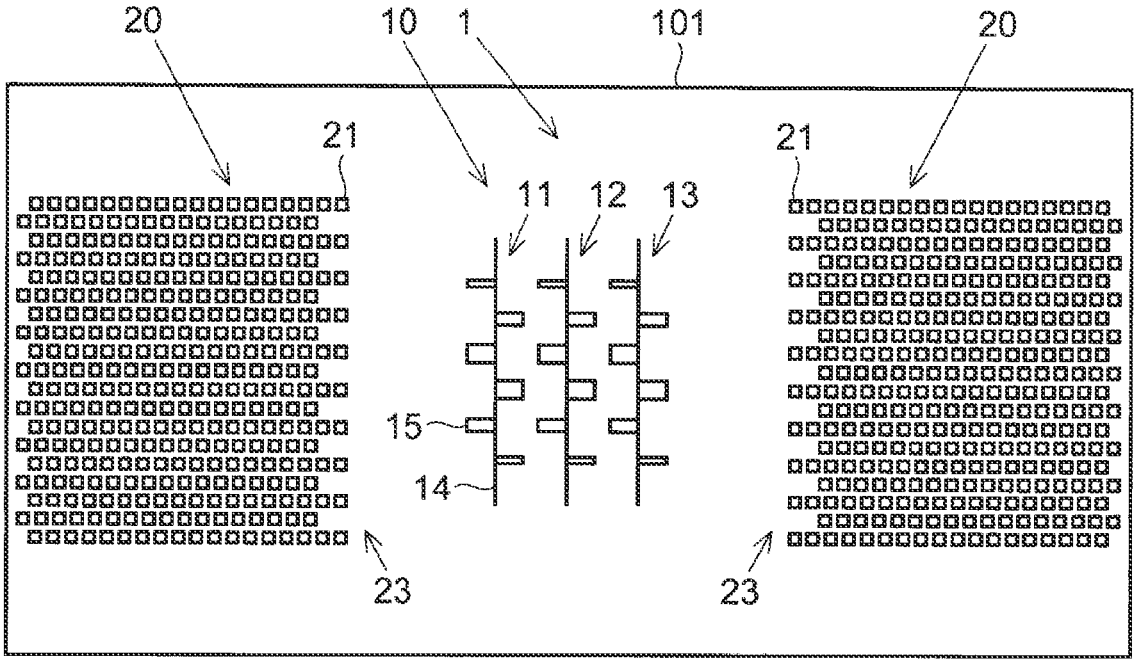
FIG. 1 is a plan view of an example antenna device according to an embodiment.
Figure 2:
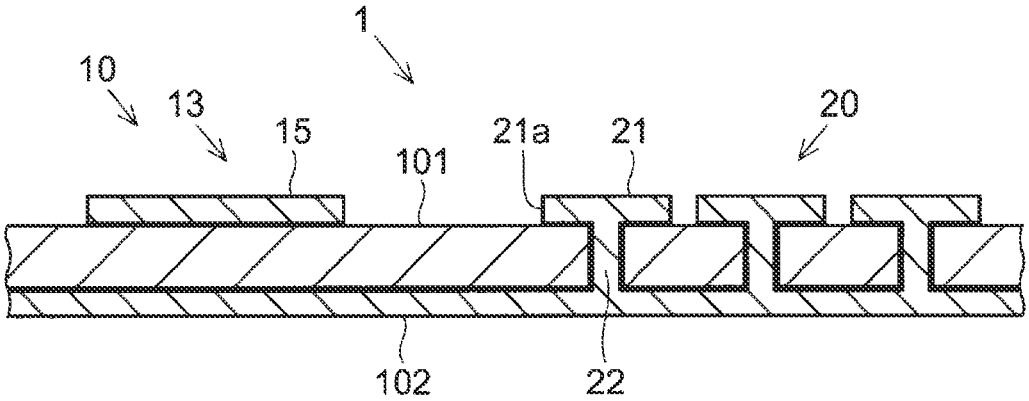
FIG. 2 is a partial sectional view of the antenna device according to the embodiment.

FIG. 1 is a plan view of an example antenna device 1 according to the embodiment. FIG. 2 is a partial sectional view of the antenna device 1 according to the embodiment. The antenna device 1 according to the embodiment is equipped with an antenna unit 10 and propagation preventive units 20. The antenna unit 10 and the propagation preventive units 20 are both formed as conductive patterns on the surface of a substrate 101.

The antenna device 1 transmits and receives radio waves by the antenna unit 10 which are formed as conductive patterns on the substrate 101. The substrate 101, which is a radio-frequency substrate, includes a dielectric base layer made of a synthetic resin such as a fluorocarbon resin or an epoxy resin and is shaped like a plate.

For example, the antenna unit 10 consists of antennas of three channels, that is, a ch1 antenna 11, a ch2 antenna 12, and a ch3 antenna 13. The ch1 antenna 11, the ch2 antenna 12, and the ch3 antenna 13 have the same structure and each of them is equipped with a feed line 14 and antenna elements 15.

The ch1 antenna 11, the ch2 antenna 12, and the ch3 antenna 13 are arranged in a direction (left-right direction in FIG. 1) that is perpendicular to the extension direction (top-bottom direction in FIG. 1) of the feed lines 14. Each of the antennas 11-13 has plural antenna elements 15 which are electrically connected to the feed line 14. For example, the plural antenna elements 15 are arranged in the extension direction of the feed line 14 so as to project leftward and rightward alternately.

The antenna device 1 is equipped with two propagation preventive units 20 which are arranged adjacent to the antenna unit 10 on the substrate 101. More specifically, the two propagation preventive units 20 are spaced from each other with the antenna unit 10 interposed between them in the direction that is perpendicular to the extension direction of the feed lines 14. One propagation preventive unit 20 is opposed to the ch1 antenna 11 and the other propagation preventive unit 20 is opposed to the ch3 antenna 13. The ch2 antenna 12 is disposed at the middle between the ch1 antenna 11 and the ch3 antenna 13. The two propagation preventive units 20 have the same structure and are each equipped with plural patches 21.

The plural patches 21 are formed as conductive patterns and arranged on the substrate 101. More specifically, each propagation preventive unit 20 is an EBG structure in which plural patches 21 are arranged periodically on the surface of the substrate 101. Each patch 21 is electrically connected to a ground portion 102 which is formed as a conductive pattern on the back surface of the substrate 101. Configured in this manner, the propagation preventive units 20 prevent radiation waves of the antenna unit 10 from propagating along the substrate 101.

2. Detailed Configuration of Antenna Device 1

2-1. Example 1

Figure 3:
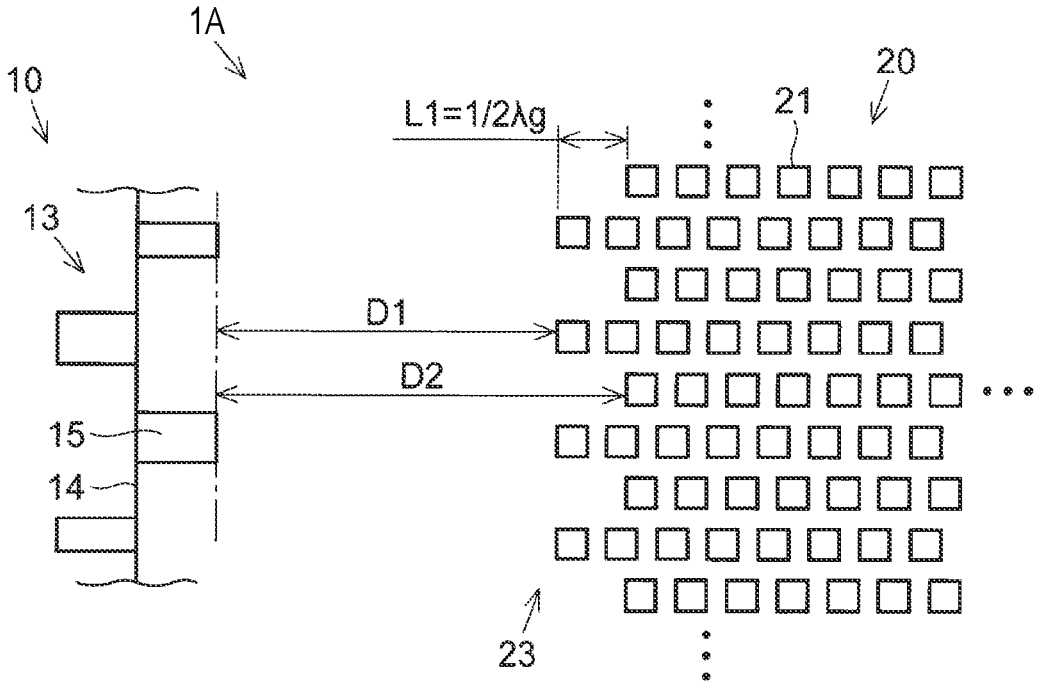
FIG. 3 is a partial plan view of an antenna device according to Example 1.

FIG. 3 is a partial plan view of an antenna device 1A according to Example 1. FIG. 3 shows part of an area including the ch3 antenna 13 of the antenna unit 10 and one propagation preventive unit 20 opposed to it. An area including the ch1 antenna 11 and the other propagation preventive unit 20 opposed to it is the same in configuration as the area. This configuration will be described representatively using FIG. 3.

Each propagation preventive unit 20 has a stepped structure 23 which is formed at the end, on the side of the antenna unit 10, of the propagation preventive unit 20. In the stepped structure 23, there are two sets of patches 21 that are arranged in the extension direction of the feed lines 14 and are closest to the feed lines 14. The two sets of patches 21 are different from each other in the position in the direction perpendicular to the extension direction of the feed lines 14. More specifically, the two sets of patches 21 are different from each other in the distance from the antenna unit 10 by a prescribed interval L1. The two sets of patches 21 have a distance D1 or a distance D2 that is longer than D1. In the stepped structure 23, the two sets of patches 21 appear alternately in the extension direction of the feed lines 14.

Figure 4A:
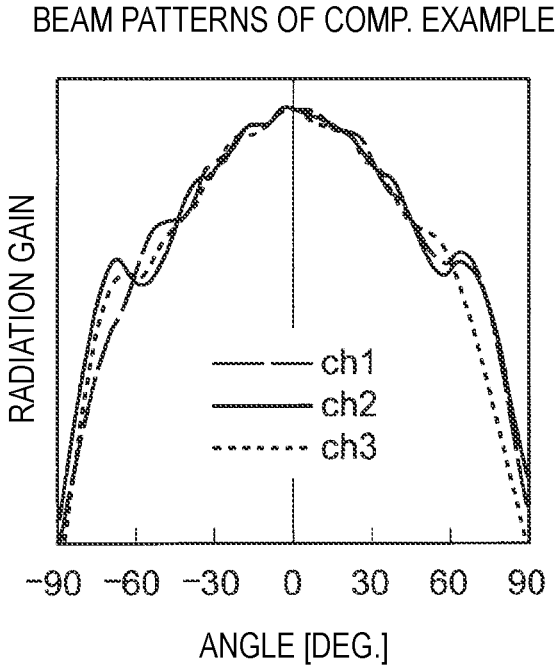
FIGS. 4A and 4B are graphs showing beam patterns of the antenna device 1A according to Example 1 and an antenna device of Comparative Example, respectively.
Figure 4B:
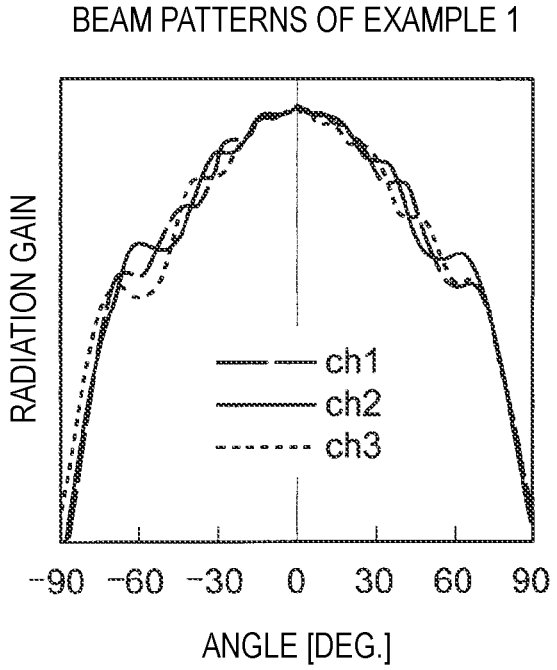

FIGS. 4A and 4B are graphs showing radiation wave beam patterns of the antenna device 1A according to Example 1 and an antenna device of Comparative Example, respectively. In the graphs of FIGS. 4A and 4B, the horizontal axis represents the expansion angle of radiation waves of the antenna device and the vertical axis represents the radiation gain of the antenna device. The antenna device of Comparative Example is equipped with an antenna unit and a propagation preventive unit that are arranged in the same manner as in the antenna device 1A according to Example 1 but each propagation preventive unit is not equipped with any stepped structure. That is, in the antenna device according to Comparative Example, the distances between the antenna unit 10 and the patches that are closest to the antenna unit 10 are constant in the extension direction of the feed lines 14.

As shown in FIG. 4A, in the antenna device of Comparative Example, the beam patterns of the ch1 antenna and the ch3 antenna are much different from the beam pattern of the center, ch2 antenna. More specifically, the beam pattern of the ch1 antenna is much different from that of the ch2 antenna on the negative wide angle side and the beam pattern of the ch3 antenna is much different from that of the ch2 antenna on the positive wide angle side.

In contrast, as shown in FIG. 4B, in the antenna device 1A according to Example 1, the beam patterns of the ch1 antenna 11 and the ch3 antenna 13 approximately coincide with the beam pattern of the center, ch2 antenna 12. There are no large differences between the beam patterns of the ch1 antenna 11, the ch2 antenna 12, and the ch3 antenna 13 on the front side and the wide angle sides.

Figure 5A:
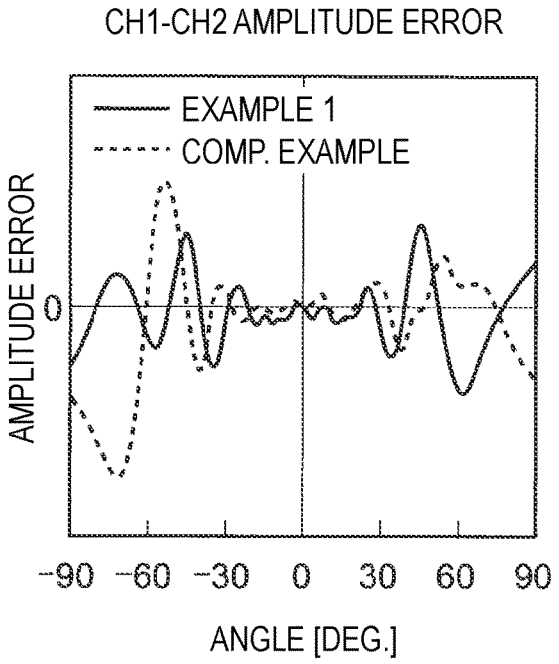
FIGS. 5A and 5B are graphs showing beam pattern amplitude errors of the antenna device according to Example 1 and the antenna device of Comparative Example.
Figure 5B:
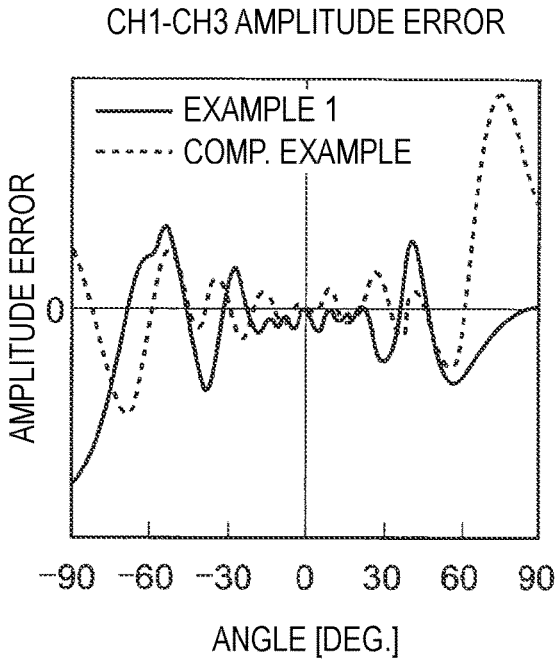

FIGS. 5A and 5B are graphs showing beam pattern amplitude errors of the antenna device 1A according to Example 1 and the antenna device of Comparative Example. FIG. 5A shows amplitude errors between the ch1 antenna and the ch2 antenna, and FIG. 5B shows amplitude errors between the ch1 antenna and the ch3 antenna. In the graphs of FIGS. 5A and 5B, the horizontal axis represents the expansion angle of radiation waves of the antenna device and the vertical axis represents the difference (amplitude error) between beam patterns of the channels. It can be said that the influence of interference waves on each antenna is small and the characteristic is better when the amplitude error is small.

As seen from FIGS. 5A and 5B, the amplitude error of the antenna device 1A according to Example 1 is smaller than that of the antenna device of Comparative Example on the front side and the wide angle sides.

In the antenna device of Comparative Example, the facts that the ch1, ch2, and ch3 antennas are much different from each other in the antenna beam pattern and the amplitude errors between them are large are due to a phenomenon that radiation waves of the ch1 antenna and the ch3 antenna are affected by interference waves from the propagation preventive units and the radiation wave beam patterns of those antennas are distorted. Interference waves from each propagation preventive unit are generated by reflection of antenna radiation waves by end surfaces 21*a* and their neighborhoods of the closest patches 21 (see FIG. 2).

On the other hand, in Example 1, interference waves from each propagation preventive unit 20 can be canceled out by the stepped structure 23. Thus, in the antenna device LA, the influence of interference waves that would otherwise distort the beam patterns of antenna radiation waves can be suppressed. As a result, the beam patterns of antenna radiation waves of the ch1 antenna 11, the ch2 antenna 12, and the ch3 antenna 13 approximately coincide with each other and the amplitude errors are small. That is, the influence of interference waves on each of the antenna 11-13 can be reduced.

Returning to FIG. 3, in the stepped structure 23, the prescribed interval L1 which is the difference between the distances D1 and D2 from the antenna unit 10 to the closest patches 21 is set equal to a ½ guide wavelength of radiation waves of the antenna unit 10. With this setting, interference waves that are reflected from the end surfaces 21*a* of the patches 21 having the distance D1 from the antenna unit 10 back to the space and interference waves that are reflected from the end surfaces 21*a* of the patches 21 having the distance D2 from the antenna unit 10 back to the space are cancel out mutually. As a result, in the antenna device 1A, the influence of interference waves that would otherwise distort the beam patterns of antenna radiation waves can be suppressed.

The shortest distance D1 between the antenna unit 10 and each stepped structure 23 is set equal to an integer multiple of the guide wavelength of radiation waves of the antenna unit 10. With this setting, the phase of radiation waves radiated from the antenna unit 10 to the space is made the same as that of interference waves that are directed toward the antenna unit 10 after reflection by the stepped structure 23. This makes it possible to suppress distortion of the beam patterns of radiation waves of the antenna unit 10. That is, the influence of interference waves that would otherwise distort the beam patterns of radiation waves of the antenna unit 10 can be suppressed.

In each stepped structure 23, the closest patches 21 having the distance D1 from the antenna unit 10 and the closest patches 21 having the distance D2 from the antenna unit 10 appear alternately in the extension direction of the feed lines 14. That is, each stepped structure 23 is shaped like a rectangular wave. With this structure, the influence of interference waves from each propagation preventive unit 20 on the antenna unit 10 can be suppressed over the entire extension length of the feed lines 14. Thus, the distortion of the beam patterns of antenna radiation waves can be improved.

Although in the embodiment the shape of each patch 21 is rectangle in a plan view, the invention is not limited to this case; each patch 21 may be shaped like another kind of polygon such as a hexagon or octagon or a circle. Where each patch 21 is shaped like a polygon or a circle, interference waves from each propagation preventive unit 20 can be canceled out by the stepped structures 23 as in the embodiment. Thus, in the antenna device 1, the influence of interference waves that would otherwise distort antenna radiation waves can be suppressed. That is, the distortion of the beam patterns of antenna radiation waves can be improved.

Figure 6:
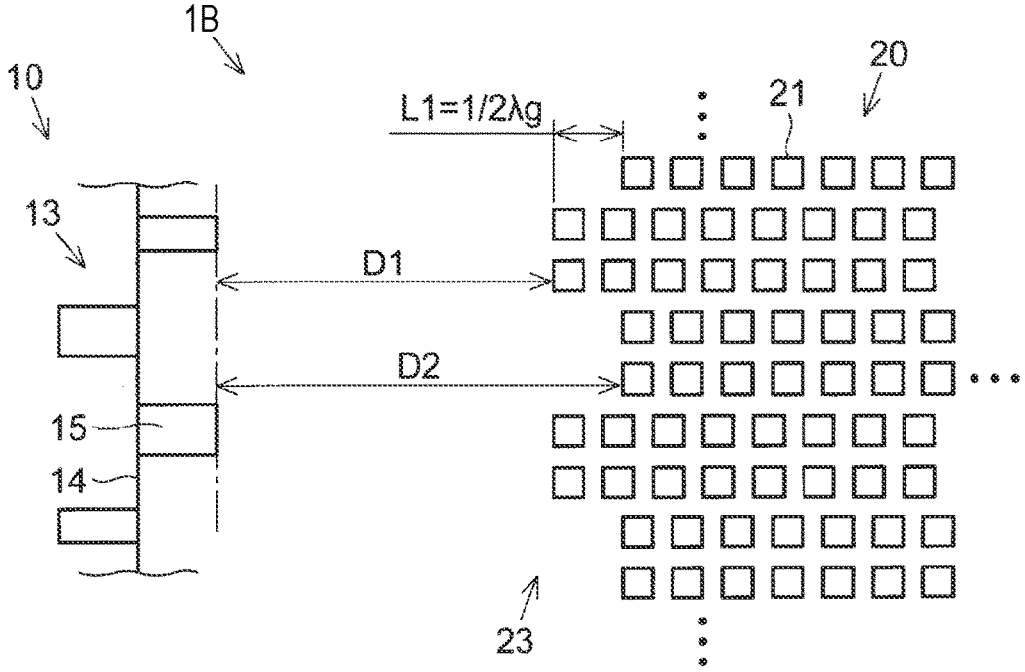
FIG. 6 is a partial plan view of the antenna device according to Modification 1.

FIG. 6 is a partial plan view of an antenna device 1B according to Modification 1. In the antenna device 1B according to Modification 1, in each stepped structure 23, there are two sets of pairs of patches 21 that are arranged in the extension direction of the feed lines 14, are closest to the feed lines 14, and have a distance D1 or D2 from the antenna unit 10. The two sets of pairs of patches 21 are arranged alternately in the extension direction of the feed lines 14. In Modification 1, as in Example 1, interference waves from each propagation preventive unit 20 can be canceled out by the stepped structure 23. Thus, in the antenna device 1B, the influence of interference waves that would otherwise distort the beam patterns of antenna radiation waves can be suppressed. That is, the distortion of the beam patterns of antenna radiation waves can be improved.

2-2. Example 2

Figure 7:
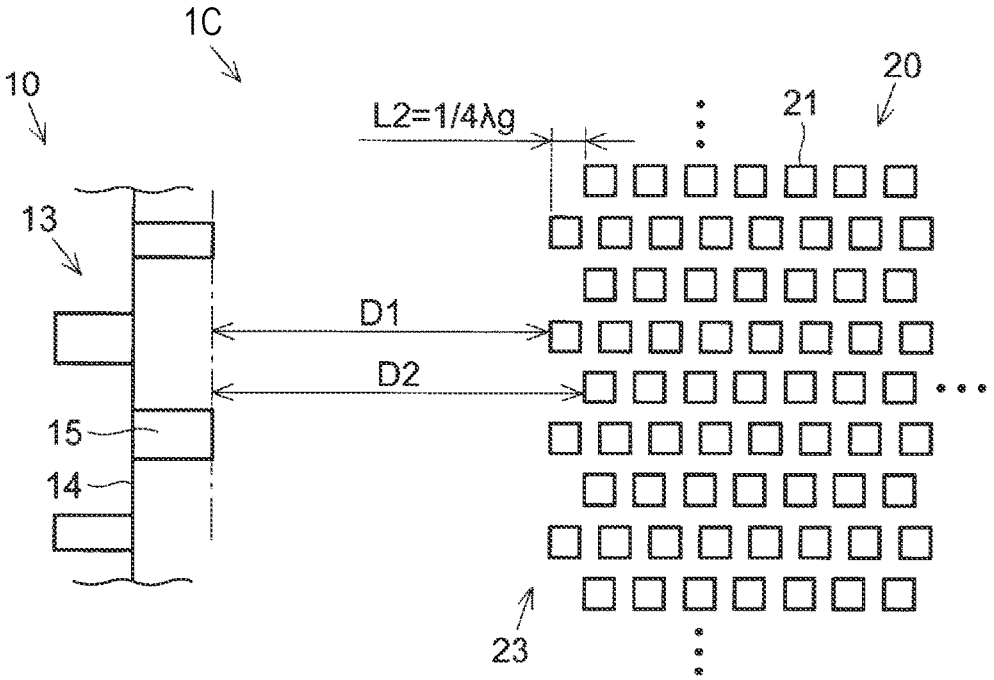
FIG. 7 is a partial plan view of an antenna device according to Example 2.

FIG. 7 is a partial plan view of an antenna device 1C according to Example 2. In the antenna device 1C according to Example 2, in each stepped structure 23, the prescribed interval L2 which is the difference between the distances D1 and D2 from the antenna unit 10 to the closest patches 21 is set equal to a ¼ guide wavelength of radiation waves of the antenna unit 10. That is, the difference between a path length with the closest patches 21 having the distance D1 from the antenna unit 10 and a path length with the closest patches 21 having the distance D2 from the antenna unit 10 is set equal to a ½ guide wavelength of radiation waves.

Figure 8A:
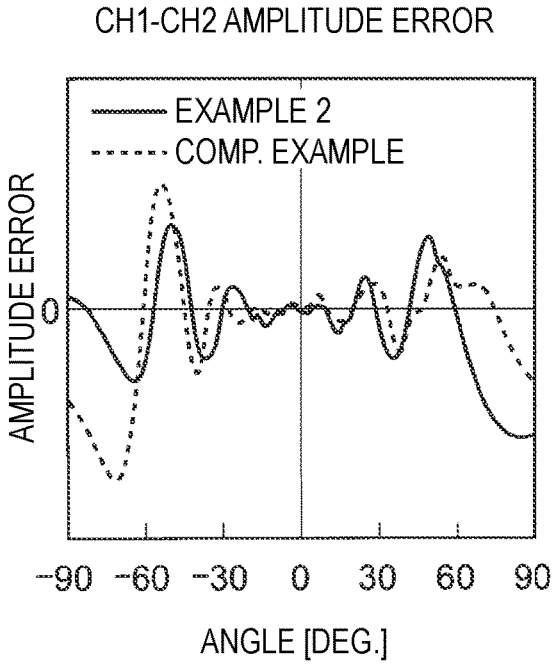
FIGS. 8A and 8B are graphs showing beam pattern amplitude errors of the antenna device according to Example 2 and the antenna device of Comparative Example.
Figure 8B:
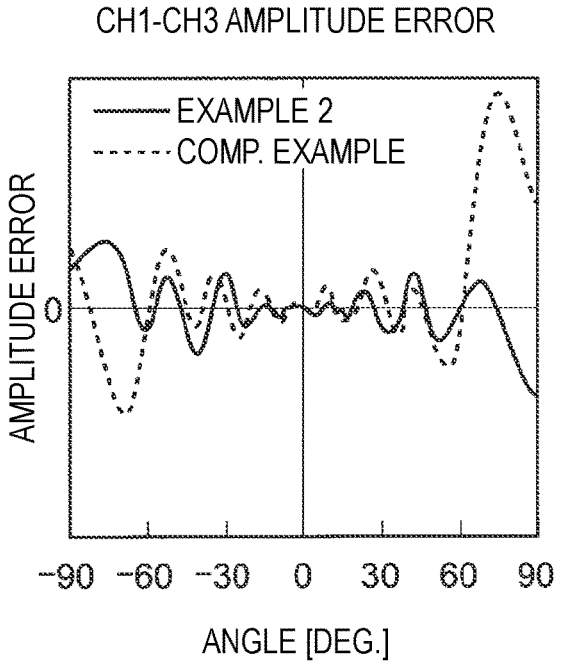

FIGS. 8A and 8B are graphs showing beam pattern amplitude errors of the antenna device 1C according to Example 2 and the antenna device of Comparative Example (the same one as was used above for comparison with Example 1). FIG. 8A shows amplitude errors between the ch1 antenna and the ch2 antenna, and FIG. 8B shows amplitude errors between the ch1 antenna and the ch3 antenna. In the graphs of FIGS. 8A and 8B, the horizontal axis represents the expansion angle of radiation waves of the antenna device and the vertical axis represents the difference (amplitude error) between beam patterns of the channels.

As seen from FIGS. 8A and 8B, the amplitude error of the antenna device 1C according to Example 2 is smaller than that of the antenna device of Comparative Example on the front side and the wide angle sides.

In Example 2, interference waves generated by reflection from the closest patches 21 having the distance D1 from the antenna unit 10 and interference waves generated by reflection from the closest patches 21 having the distance D2 from the antenna unit 10 can be canceled out mutually. As a result, in the antenna device 1C, the influence of interference waves that would otherwise distort the beam patterns of antenna radiation waves can be suppressed.

2-3. Example 3

Figure 9:
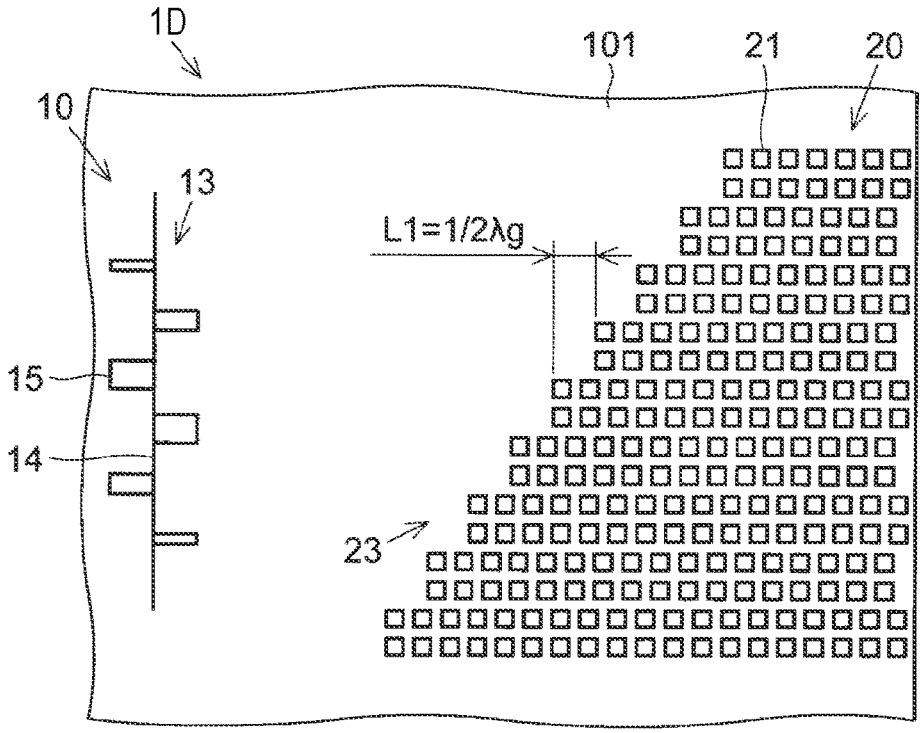
FIG. 9 is a partial plan view of an antenna device according to Example 3.

FIG. 9 is a partial plan view of an antenna device 1D according to Example 3. In the antenna device 1D according to Example 3, each stepped structure 23 is inclined with respect to the extension direction of the feed lines 14 while being stepped. More specifically, in each stepped structure 23, the closest patches 21 are arranged in such a manner as to go away from the antenna unit 10 by a prescribed interval L1 as the position in the extension direction of the feed lines 14 comes closer to its one end (i.e., goes upward in FIG. 9) by two pitches 21.

Although in each stepped structure 23 employed in Example 3 the distance between the antenna unit 10 and the closest patch 21 is changed by the prescribed interval L1 (½ guide wavelength) at each step, the distance between the antenna unit 10 and the closest patch 21 may be changed by the prescribed interval L2 (¼ guide wavelength) at each step. Although in each stepped structure 23 employed in Example 3 the distance between the antenna unit 10 and the closest patch 21 is changed by the prescribed interval L1 at each step that appears every two patches 21 in the extension direction of the feed lines 14, the distance between the antenna unit 10 and the closest patch 21 may be changed by the prescribed interval L1 at each step that appears every patch 21 in the extension direction of the feed lines 14. These structures may also be applied to Modification 2 and Modification 3 to be described later.

Figure 10A:
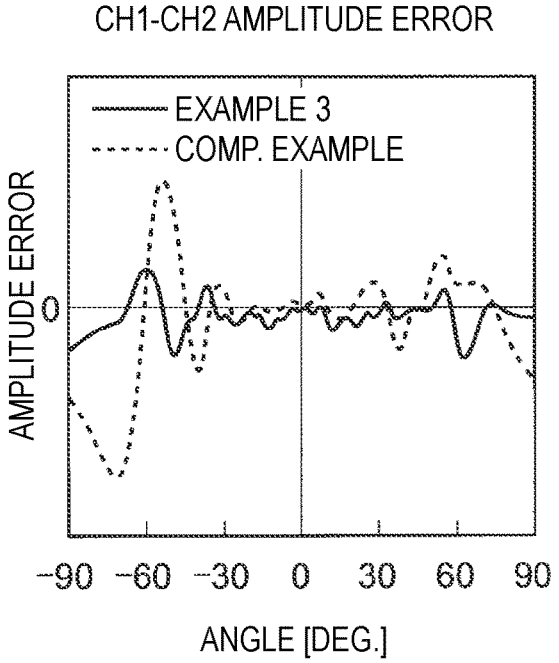
FIGS. 10A and 10B are graphs showing beam pattern amplitude errors of the antenna device according to Example 3 and the antenna device of Comparative Example.
Figure 10B:
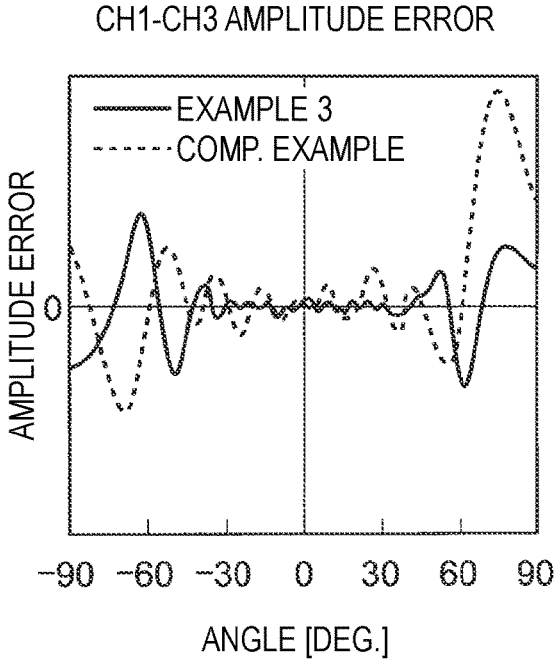

FIGS. 10A and 10B are graphs showing beam pattern amplitude errors of the antenna device 1E according to Example 3 and the antenna device of Comparative Example (the same one as was used above for comparison with Example 1). FIG. 10A shows amplitude errors between the ch1 antenna and the ch2 antenna, and FIG. 10B shows amplitude errors between the ch1 antenna and the ch3 antenna. In the graphs of FIGS. 10A and 10B, the horizontal axis represents the expansion angle of radiation waves of the antenna device and the vertical axis represents the difference (amplitude error) between beam patterns of the channels.

As seen from FIGS. 10A and 10B, the amplitude error of the antenna device 1E according to Example 3 is smaller than that of the antenna device of Comparative Example on the front side and the wide angle sides.

In Example 3, interference waves from each propagation preventive unit 20 can be diverted to a direction that is different from the direction in which the antenna unit 10 exists. Furthermore, where the distance between the antenna unit 10 and the closest patch 21 is changed by the prescribed interval L1 (½ guide wavelength) at each step, interference waves generated by the end surfaces 21*a* of the closest patches 21 toward the space can be canceled out. Where the distance between the antenna unit 10 and the closest patch 21 is changed by the prescribed interval L2 (¼ guide wavelength) at each step, interference waves generated by reflection by the end surfaces 21*a* of the closest patches 21 and going toward the antenna unit 10 can be canceled out mutually. With these measures, in the antenna device 1D, the influence of interference waves that would otherwise distort the beam patterns of antenna radiation waves can be suppressed.

Figure 11:
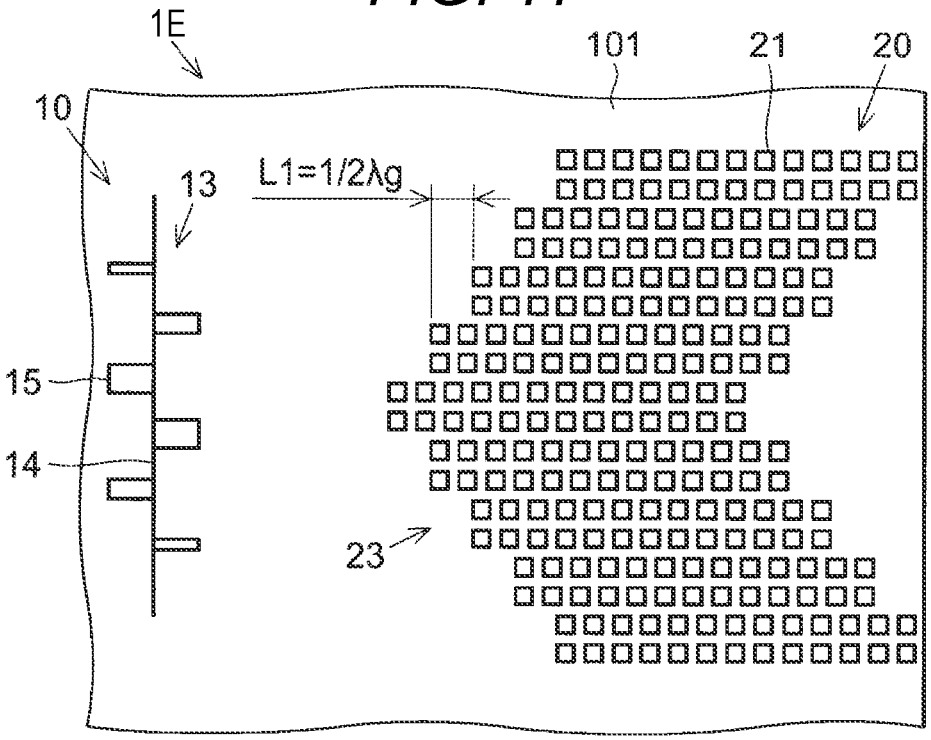
FIG. 11 is a partial plan view of an antenna device according to Modification 2.

FIG. 11 is a partial plan view of an antenna device 1E according to Modification 2. In the antenna device 1E according to Modification 2, each stepped structure 23 is inclined with respect to the extension direction of the feed lines 14 so as to go away from the antenna unit 10 as the position in the extension direction of the feed lines 14 goes away from its center and comes closer to either of its ends (i.e., goes upward or downward in FIG. 11) while being stepped. In Modification 2, as in Example 3, interference waves from each propagation preventive unit 20 can be diverted to a direction that is different from the direction in which the antenna unit 10 exists. Furthermore, interference waves from each propagation preventive unit 20 can be canceled out mutually by means of the stepped structure 23. As a result, in the antenna device 1E, the influence of interference waves that would otherwise distort the beam patterns of antenna radiation waves can be suppressed. That is, the degree of distortion of the beam patterns of antenna radiation waves can be improved.

Figure 12:
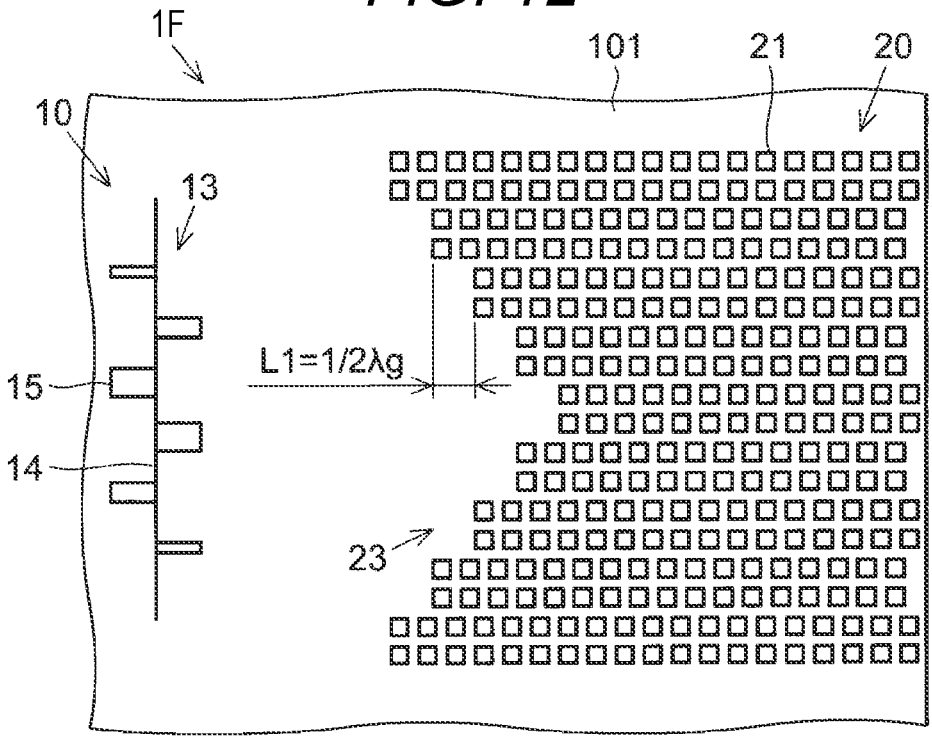
FIG. 12 is a partial plan view of an antenna device according to Modification 3.

FIG. 12 is a partial plan view of an antenna device 1F according to Modification 3. In the antenna device 1F according to Modification 3, each stepped structure 23 is inclined with respect to the extension direction of the feed lines 14 so as to come closer to the antenna unit 10 as the position in the extension direction of the feed lines 14 goes away from its center and comes closer to either of its ends (i.e., goes upward or downward in FIG. 12) while being stepped. In Modification 3, as in Example 3, interference waves from each propagation preventive unit 20 can be diverted to a direction that is different from the direction in which the antenna unit 10 exists. Furthermore, interference waves from each propagation preventive unit 20 can be canceled out mutually by means of the stepped structure 23. As a result, in the antenna device 1F, the influence of interference waves that would otherwise distort the beam patterns of antenna radiation waves can be suppressed. That is, the degree of distortion of the beam pattern of antenna radiation waves can be improved.

Comparison Between Examples

Figure 13A:
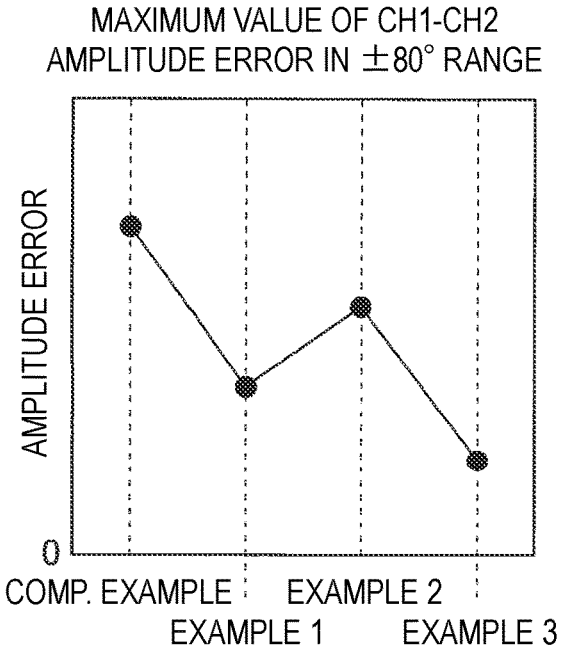
FIGS. 13A and 13B are graphs showing maximum values of beam pattern amplitude errors in the antenna devices according to Examples 1-3.
Figure 13B:
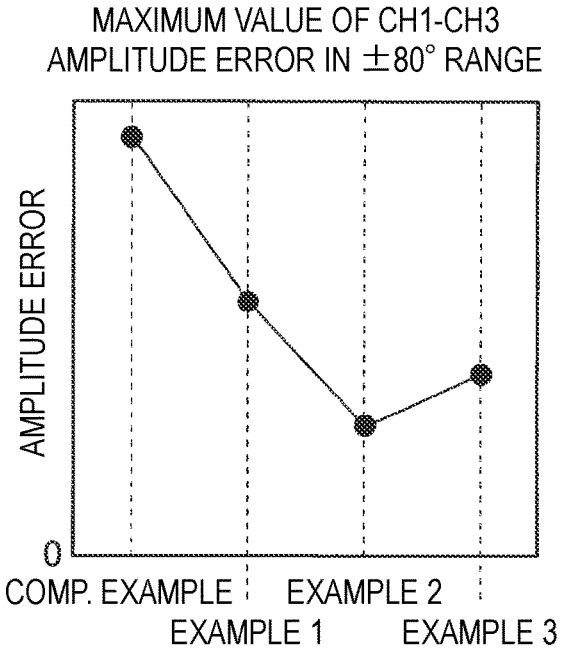

FIGS. 13A and 13B are graphs showing maximum values of beam pattern amplitude errors of the antenna device 1A, 1C, and 1D according to Examples 1-3. FIG. 13A shows maximum values of amplitude errors between the ch1 antenna 11 and the ch2 antenna 12 in an angular range of ±80°, and FIG. 13B shows maximum values of amplitude errors between the ch1 antenna 11 and the ch3 antenna 13 in an angular range of ±80°. FIGS. 13A and 13B allow comparison between beam pattern amplitude errors of the antenna device 1A, 1C, and 1D according to Examples 1-3 and beam pattern amplitude errors of the antenna device of Comparative Example.

As seen from FIGS. 13A and 13B, in the antenna device 1A, 1C, and 1D according to Examples 1-3, amplitude errors between the ch1 antenna 11 and the ch2 antenna 12 and amplitude errors between the ch1 antenna 11 and the ch3 antenna 13 can be made smaller than those of the antenna device of Comparative Example. In particular, in the antenna device 1D according to Example 3, amplitude errors between the ch1 antenna 11 and the ch2 antenna 12 can be made smallest. In the antenna device 1C according to Example 2, amplitude errors between the ch1 antenna 11 and the ch3 antenna 13 can be made smallest.

Figure 14A:
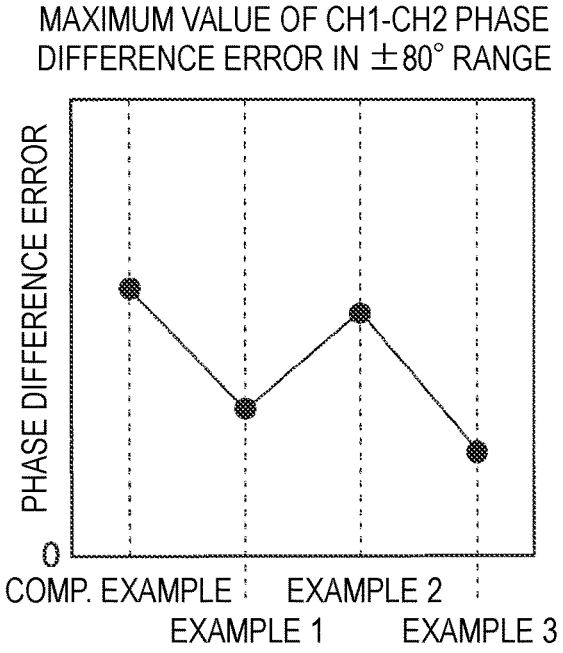
FIGS. 14A and 14B are graphs showing maximum values of phase difference errors of reception waves in the antenna devices according to Examples 1-3.
Figure 14B:
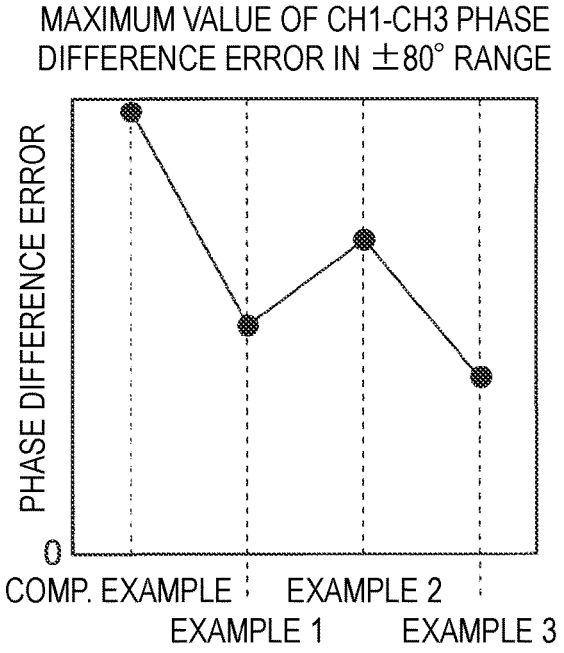

FIGS. 14A and 14B are graphs showing maximum values of phase difference errors of reception waves of the antenna device 1A, 1C, and 1D according to Examples 1-3. The term "phase difference error" means the difference between a phase difference of reception waves derived by a theoretical calculation and that of actual reception waves. It can be said that the influence of interference waves on each antenna is smaller and hence better characteristics can be obtained when the phase difference error is smaller.

FIG. 14A shows maximum values of phase difference errors between the ch1 antenna 11 and the ch2 antenna 12 in an angular range of ±80°, and FIG. 14B shows maximum values of phase difference errors between the ch1 antenna 11 and the ch3 antenna 12 in an angular range of ±80°. FIGS. 14A and 14B allow comparison between phase difference errors of the antenna device 1A, 1C, and 1D according to Examples 1-3 and phase difference errors of the antenna device of Comparative Example.

As seen from FIGS. 14A and 14B, in the antenna device 1A, 1C, and 1D according to Examples 1-3, phase difference errors between the ch1 antenna 11 and the ch2 antenna 12 and phase difference errors between the ch1 antenna 11 and the ch3 antenna 13 can be made smaller than those of the antenna device of Comparative Example. In particular, in the antenna device 1D according to Example 3, amplitude errors between the ch1 antenna 11 and the ch2 antenna 12 and amplitude errors between the ch1 antenna 11 and the ch3 antenna 13 can be made smallest.

3. Others

The various technical features disclosed in the specification in the form of the embodiment can be modified in various manners without departing from the spirit and scope of the technical concept of the invention. That is, the embodiment is just examples in all aspects and should not be construed as being restrictive. It should be understood that the technical scope of the invention is determined by the claims rather than the description of the embodiment and encompasses all modifications that are made within the confines of the claims and their equivalents. Parts of the above-described Examples and Modifications may be combined together in practicing the invention.

Although in the embodiment the two propagation preventive units 20 are arranged on the two respective sides of the antenna unit 10 in the direction that is perpendicular to the extension direction of the feed lines 14 so as to be spaced from the latter, the manner of formation of the propagation preventive unit (s) 20 is not limited this. For example, only one propagation preventive unit 20 may be formed. Or the propagation preventive units 20 may be arranged so as to be spaced from the antenna unit 10 in the extension direction of the feed lines 14.

In each propagation preventive unit 20, a structure that is equivalent to the stepped structure 23 may either be formed or not be formed at its end on the side adjacent to the outer periphery of the substrate 101. This increases the degree of freedom of formation of a stepped structure 23 at that end.

What is claimed is:

1. An antenna device comprising:

an antenna unit provided as a conductive pattern on a substrate; and a propagation preventive unit which is provided adjacent to the antenna unit and prevents propagation of radiation waves of the antenna unit along the substrate, wherein the propagation preventive unit is provided as a conductive pattern on the substrate, has plural patches arranged in a prescribed pattern, and has, at an entirety of an end on a side of the antenna unit, a stepped structure in which a distance from a position of the antenna unit to one of the patches closest to the position of the antenna unit varies by a prescribed interval every time the position in an extension direction of a feed line of the antenna unit is changed by a prescribed distance, and in the stepped structure, a first patch having a first distance from a position of the antenna unit closest to the first patch and a second patch having a second distance from a position of the antenna unit closest to the second patch are alternately arranged along the extension direction of the feed line of the antenna unit, the first distance being different from the second distance.

2. The antenna device according to claim 1, wherein the prescribed interval is equal to a ½ guide wavelength of radiation waves of the antenna unit.

3. The antenna device according to claim 2, wherein a shortest one of distances from the antenna unit to the closest patches of the stepped structure is equal to an integer multiple of a guide wavelength of radiation waves of the antenna unit.

4. The antenna device according to claim 2, wherein each of the plural patches has a multangular shape or a circular shape.

5. The antenna device according to claim 1, wherein the prescribed interval is equal to a ¼ guide wavelength of radiation waves of the antenna unit.

6. The antenna device according to claim 5, wherein a shortest one of distances from the antenna unit to the closest patches of the stepped structure is equal to an integer multiple of a guide wavelength of radiation waves of the antenna unit.

7. The antenna device according to claim 5, wherein each of the plural patches has a multangular shape or a circular shape.

8. The antenna device according to claim 1, wherein a shortest one of distances from the antenna unit to the closest patches of the stepped structure is equal to an integer multiple of a guide wavelength of radiation waves of the antenna unit.

9. The antenna device according to claim 8, wherein each of the plural patches has a multangular shape or a circular shape.

10. The antenna device according to claim 1, wherein each of the plural patches has a multangular shape or a circular shape.

* * * * *